US008430629B2

(12) United States Patent
Turi et al.

(10) Patent No.: US 8,430,629 B2
(45) Date of Patent: Apr. 30, 2013

(54) ASSEMBLY FOR A STATOR STAGE OF A TURBOMACHINE, THE ASSEMBLY COMPRISING AN OUTER SHROUD AND AT LEAST ONE STATIONARY VANE

(75) Inventors: Gabriel Turi, Liege (BE); Guy Biemar, Blegny-Saive (BE)

(73) Assignee: Techspace Aero, Milmort Herstal (BE)

( * ) Notice: Subject to any disclaimer, the term of this patent is extended or adjusted under 35 U.S.C. 154(b) by 809 days.

(21) Appl. No.: 12/648,836

(22) Filed: Dec. 29, 2009

(65) Prior Publication Data

US 2011/0033285 A1 Feb. 10, 2011

(30) Foreign Application Priority Data

Dec. 29, 2008 (EP) ..... 08173011

(51) Int. Cl.
*F04D 29/40* (2006.01)

(52) U.S. Cl.
USPC ..... 415/189; 415/190; 415/191; 415/209.3

(58) Field of Classification Search ..... 415/189, 415/190, 191, 209.3
See application file for complete search history.

(56) References Cited

U.S. PATENT DOCUMENTS

| | | | | |
|---|---|---|---|---|
| 2,834,537 A | | 5/1958 | Neary | |
| 3,985,465 A | * | 10/1976 | Sheldon et al. | 415/189 |
| 3,997,280 A | * | 12/1976 | Germain | 415/189 |
| 4,014,627 A | * | 3/1977 | Heurteux | 415/189 |
| 4,142,827 A | * | 3/1979 | Vinciguerra | 415/189 |
| 4,643,636 A | | 2/1987 | Libertini et al. | |
| 5,547,342 A | * | 8/1996 | Furseth et al. | 415/200 |
| 6,196,794 B1 | * | 3/2001 | Matsumoto | 415/191 |
| 6,543,995 B1 | * | 4/2003 | Honda et al. | 415/189 |

FOREIGN PATENT DOCUMENTS

| | | |
|---|---|---|
| EP | 0384166 A2 | 8/1990 |
| GB | 599391 | 3/1948 |
| GB | 2 177 164 A | 1/1987 |
| JP | 59-180006 | 10/1984 |

* cited by examiner

*Primary Examiner* — Igor Kershteyn
(74) *Attorney, Agent, or Firm* — Oblon, Spival, McClelland, Maier & Neustadt, L.L.P.

(57) ABSTRACT

An assembly for a stator stage of a turbomachine is disclosed. The assembly includes: an outer shroud presenting a series of openings for mounting each stationary vane by welding between the edge of an opening and the outline of the platform of the vane, the outline of the outer segment of an opening surrounding, in radial projection, the outline of the inner segment thereof, the shroud not having any other holes; and at least one stationary vane with its top including a non-pierced platform received in one of the openings prior to the welding step, such that an inside face of the platform bears against a bearing face of the shroud, the outline of the platform presenting a shape that is identical to the shape of the outline of the opening.

15 Claims, 5 Drawing Sheets

ASSEMBLY FOR A STATOR STAGE OF A TURBOMACHINE, THE ASSEMBLY COMPRISING AN OUTER SHROUD AND AT LEAST ONE STATIONARY VANE

FIELD OF THE INVENTION

The invention relates to a stationary vane and the outer shroud of a stator stage of a turbomachine such as a turbojet or a turboprop, the shroud forming a casing that supports a plurality of series of stationary vanes having series of blades disposed therebetween, which blades are movable in rotation about a longitudinal axis, in particular for an axial compressor or a turbine used in an aviation turbojet.

In the present specification, the axis X-X' of rotation of the rotor of the turbomachine is referred to as the axis of the turbomachine and it also constitutes an axis of circular symmetry for the shroud and the stator stage. The axial direction corresponds to the direction of the turbomachine axis and a radial direction is a direction perpendicular to said axis. Likewise, an axial plane is a plane containing the turbomachine axis, a transverse plane is a plane perpendicular to said axis, and a radial plane is a plane perpendicular to the other two.

The adjectives "inner" and "outer" are likewise used relative to a radial direction, such that the (radially) inner portion or face of an element is closer to the turbomachine axis, i.e. to the axis X-X' of circular symmetry of the shroud and of the stator stage, than is the (radially) outer portion or face of the same element.

The present invention also relates to a stator stage assembly for an axial compressor, the assembly comprising an outer shroud and at least one stationary vane; and an axial compressor operating at low or high pressure including such an assembly; and also a turbomachine including such an axial compressor; a turbine including such an assembly; and a turbomachine including such a turbine.

The invention also relates to: a stator stage for an axial compressor including at least one assembly as mentioned above; and an axial compressor including such a stator stage; and also a turbomachine including such an axial compressor; a turbine including such a stator stage; and a turbomachine including such a turbine.

The present invention also relates to a method of mounting at least one stationary vane by welding between the top thereof and an outer shroud.

The outer shroud forms a segment of the radially outer boundary of the air-flow section along which air flows through the stator stages of the compressor or of the turbine of a turbomachine.

During operation of a turbojet, in particular a present-day civilian or military engine, and given the risk of a foreign body penetrating into the stator stage, e.g. a bird, or even a piece broken off a part of the turbojet itself, it is necessary to ensure increased strength for the rigid connection between the stationary vanes and the outer shroud.

BACKGROUND OF THE INVENTION

This connection between the stationary vanes and the outer shroud is usually provided by attachment elements that include threaded portions, such as nut-and-bolt fastener assemblies, as described in document EP 1 801 357.

Nevertheless, there exist certain drawbacks if a threaded bolt is used at the top of a vane and penetrates into an opening in the shroud, where it is held by a nut screwed onto the outside of the shroud. The presence of a screw thread leads to the risk of the thread breaking, there are corresponding fabrication costs, and account needs to be taken of the weight of the nut.

In addition, other problems are encountered when using known techniques for mounting by welding.

Thus, document U.S. Pat. No. 5,474,419 provides in particular for welding the tops of stationary vanes in openings passing through the outer shroud and presenting a shape that is complementary to the tops of the vanes.

However, in order to achieve the required strength, it is necessary for the welding that connects the shroud to an end portion of the top of the vane to be performed through the entire thickness of the material of the outer shroud, which, given the welding techniques that can be implemented, necessarily gives rise to a melt bath through the entire thickness of the material of the shroud, thereby giving rise to droplets of material being spattered on the inside face of the shroud, and thus in the air-flow section.

It will be understood that such welding through the entire thickness gives rise to drawbacks, including the following:

- deformation of the welded parts, and in particular of the outer shroud;
- spattering of droplets of material giving rise, together with the weld bead, to surface discontinuities in the inside face of the outer shroud, thereby disturbing the stream and generating head loss in the air-flow section, such that in order to remove these surface discontinuities it is necessary to take further action on the assembly made up of the outer shroud and the welded stationary vanes, which action is complex and gives rise to additional fabrication costs, and can also give rise to other mechanical defects on those parts;
- strict fabrication tolerances are necessary for complying with the dimensions and the positioning of the openings in the outer shroud; and
- fabrication difficulties associated with the complex shape of the end portions of the tops of the vanes and the openings in the outer shroud, with this arising either during the machining of these elements or during the step of welding them together.

OBJECTS AND SUMMARY OF THE INVENTION

An object of the present invention is to provide a solution enabling the drawbacks of the prior art to be overcome, and in particular making it possible to avoid encountering the above-mentioned problems inherent to screw-thread fastener techniques or to implementing welding through the entire thickness of the outer shroud.

In a first aspect of the present invention, there is provided a vane that is to form a stationary vane of a stator stage of a turbomachine, the vane comprising a root and a top between which there extends the body (or "airfoil") of the vane, which is connected to the top via an engagement portion, wherein the top includes a non-pierced platform constituting the terminal end portion thereof, the platform being of an outline that surrounds the engagement portion of the vane, and wherein the outline of the platform presents the shape of a regular polygon, in particular a quadrilateral, specifically a rectangle, or else a kidney shape.

In a second aspect of the present invention, there is also provided an outer shroud for a stator stage of a turbomachine, the shroud including a transversely-aligned series of openings suitable for receiving the tops of respective stationary vanes, each including a platform that is suitable for penetrating into a respective one of said openings so as to enable each stationary vane to be mounted by welding between the edge of an opening and the outline of the platform, each opening having an inner segment opening into the inside face of the shroud and an outer segment (forming a setback) opening into the outside face of the shroud, the outline of the outer segment surrounding, in radial projection, and with a certain amount of separation, the outline of the inner segment, thereby defining a bearing face facing towards the outer segment, the shroud not including any other holes for mounting the vanes.

When it is stated in the present application that the first outline of a first portion/part surrounds the second outline of a second portion/part, and unless specified to the contrary, that means the second outline is inscribed within the first outline with spacing between the first and second outlines, which outlines are thus at a distance from each other.

Furthermore, in a third aspect of the present invention, there is provided an assembly for a stator stage of a turbomachine, the assembly comprising:

an outer shroud presenting a transversely-aligned series of openings for mounting stationary vanes, each including a platform that is suitable for penetrating into a respective one of said openings so as to enable each stationary vane to be mounted by welding between the edge of an opening and the outline of the platform, each opening having an inner segment opening into the inside face of the shroud and an outer segment opening into the outside face of the shroud (forming a setback), the outline of the outer segment surrounding, in radial projection, the outline of the inner segment, thereby defining a bearing face facing towards the outer segment, the shroud not including any other holes for mounting the vanes, and the outline of the outer segment presenting the shape of a quadrilateral, in particular a rectangle; and at least one stationary vane comprising a root and a top with the body of the vane extending therebetween, which body is connected to the top by an engagement portion, the top including a non-pierced platform that is received in a respective one of said openings prior to the welding step so that an inside face of the platform bears against bearing face of the shroud, the outline of the platform presenting a shape that is identical to the outline of the opening.

In a first embodiment, the platform comprises a single stage and it is constituted by an outer portion. Under such circumstances, the engagement portion is formed by a fraction of the vane body (its outer segment) and by the connection zone between the vane body and the platform.

In a second embodiment, the platform has two stages. Under such circumstances, the platform has an outer portion forming the end of the top, and also an inner portion forming a part of the engagement portion and connecting the outer portion to the remainder of the vane, the outline of the outer portion surrounds, in radial projection, the outline of the inner portion.

In this way, it can be understood that the vane is mounted permanently on the outer shroud by forming a welded connection between the outline of the outer segment of an opening and the outline of the outer portion of the platform.

In this way, since the outline of the outer segment of an opening in the outer shroud is offset, in radial projection, around the outline of the inner segment of the same opening, the welding operation performed all around the outline of the outer segment does not affect the vane thermally. In this way, no droplets of material are formed in the air-flow section.

This solution also presents the supplementary advantage of making it possible, additionally, to avoid using a specific part known as a "beam stopper" that is usually used to prevent the welding beam thermally affecting the remainder of the vane. In the invention, it is the zone of the inside wall of the outer shroud lying between the two openings that performs this function.

Likewise, the offset, in radial projection, between the outline of the outer segment of an opening in the outer shroud and the outline of the inner segment of the same opening defines a stub in the inside wall zone of the outer shroud that presents the bearing face facing towards the outer segment of the opening and against which the inside face of the platform bears.

Overall, by means of the solution of the present invention, it is possible to avoid the presence of a weld bead or of droplets of welding within the air-flow section.

Overall, by means of the solution of the present invention, it is possible to position each stationary vane reliably relative to the shroud.

BRIEF DESCRIPTION OF THE DRAWINGS

Other advantages and characteristics of the invention appear on reading the following description made by way of example and with reference to the accompanying drawings, in which.

MORE DETAILED DESCRIPTION

Figure 1:
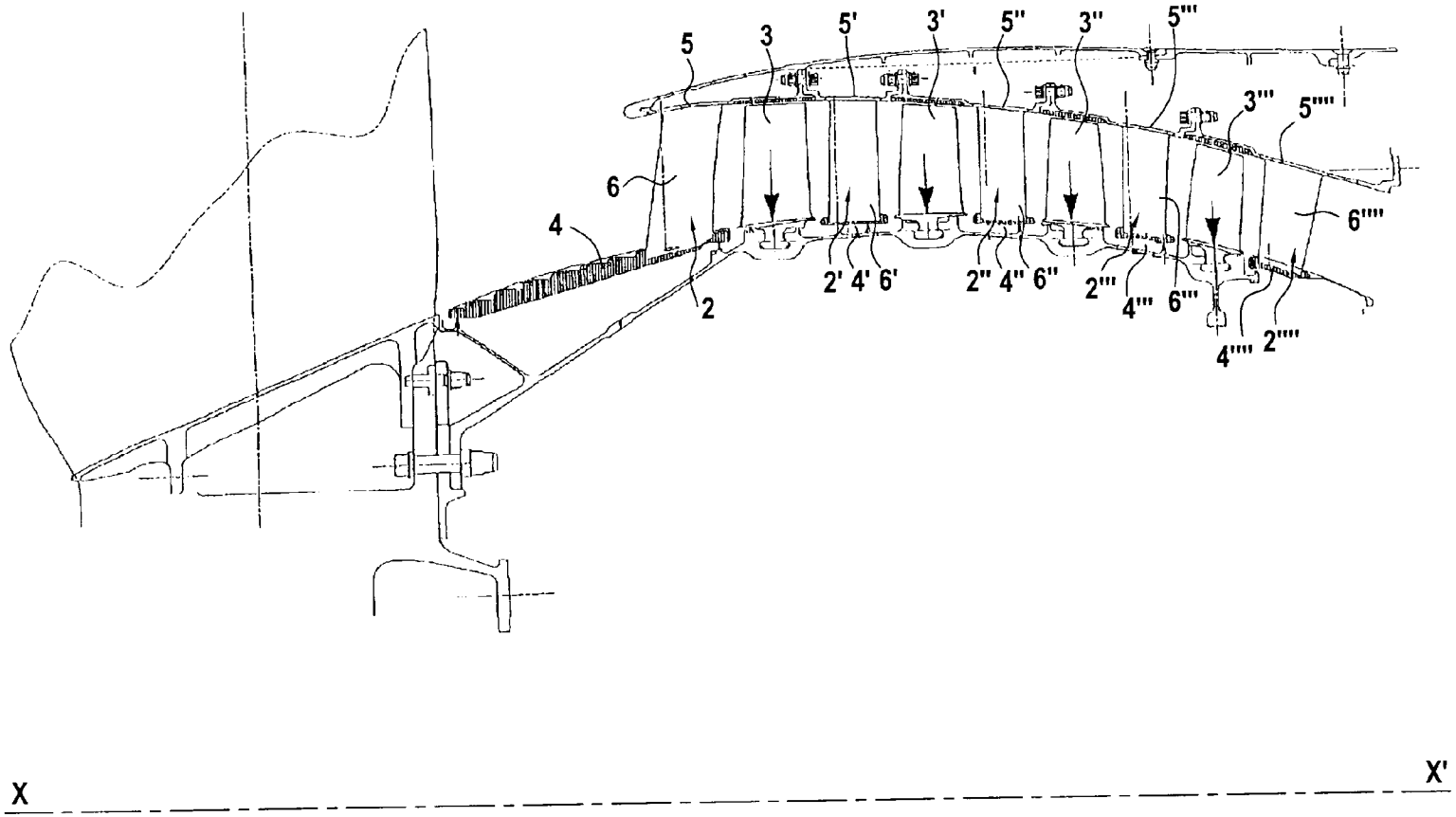
FIG. 1 is a general half-view in section on a plane containing the axis of the compression stage of a bypass turbojet.

FIG. 1 shows an example of an application of the present invention to each stator stage 2, 2', 2", 2''', 2'''' interposed between each series of moving blades 3, 3', 3", 3''' of the compressor in a bypass turbojet.

Thus, the stator stage 2 has an outer shroud 5 and an inner shroud 4 that are concentric about the axis of symmetry and rotation X-X', with a series of stationary vanes 6 being mounted between them.

In the description below, consideration is given to various implementations of the solution of the present invention for securing the tops of the stationary vanes 6 to the outer shroud 5, as shown in FIGS. 2 to 8.

Reference is made initially to FIGS. 2 to 5 which relate to a first embodiment of the invention.

Like all of the stationary vanes making up the stator stage 2 under consideration, the vane 6 is connected via its root to the inner shroud 4 and via its top 62 to the outer shroud 5, the body 61 of the vane extending between the root and the top 62.

At the top 62, the body 61 of the vane is extended by a platform 621 via a connection zone 623 in the form of a connecting radius. The mean planes of the platform 621 and of the body 61 are mutually orthogonal.

Figure 3:
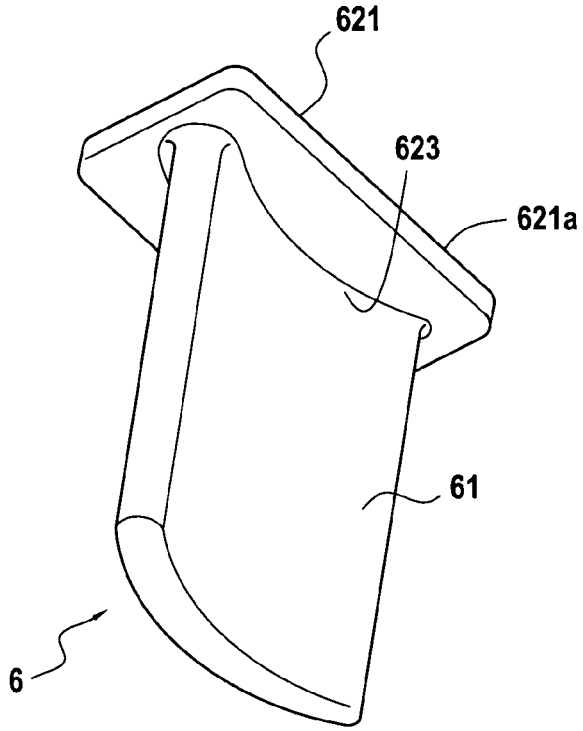
FIG. 3 is a fragmentary perspective view of the FIG. 2 vane.
Figure 4:
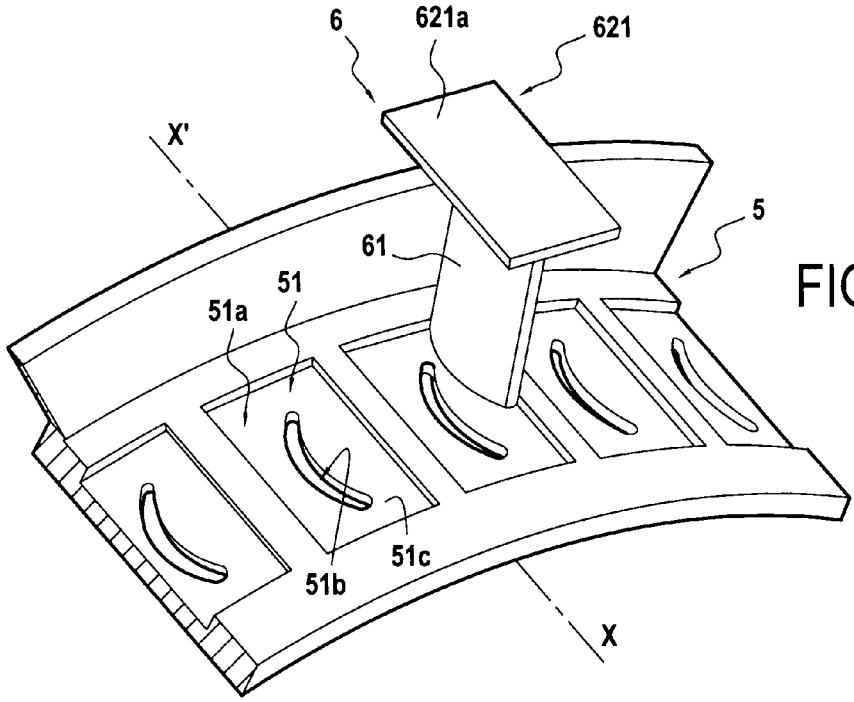
FIG. 4 is a fragmentary perspective view of the outer shroud of FIG. 2.

As can be seen in FIGS. 3 and 4, the outline of the platform 621 presents the shape of a quadrilateral, more precisely of a parallelogram, and in particular of a rectangle of length that extends parallel to the width of the body 61 of the vane and of width that extends perpendicularly to the axial direction X-X' of the shroud 5 (or of the turbomachine).

Figure 5:
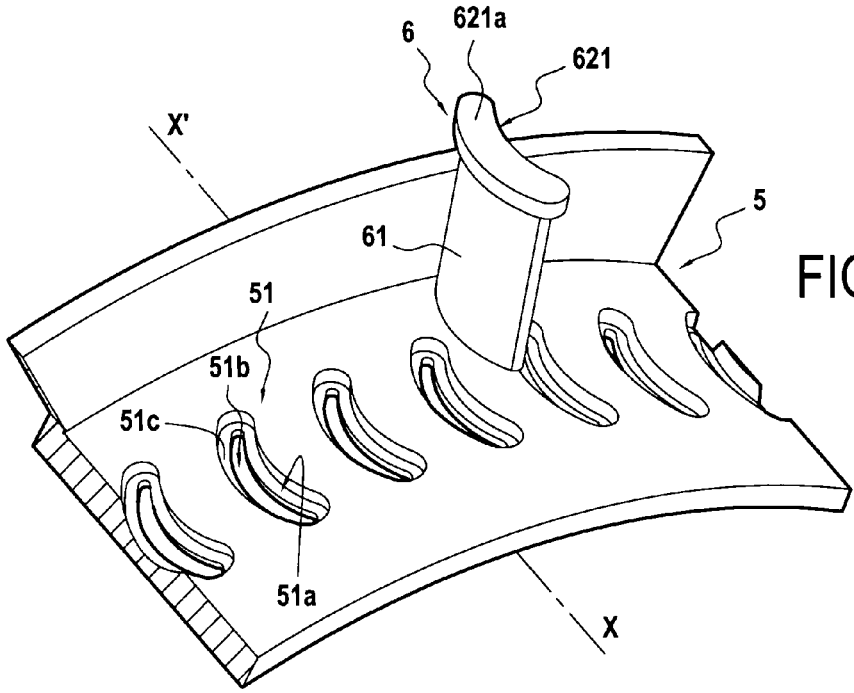
FIG. 5 is a view analogous to that of FIG. 4 for a variant embodiment.

The variant of FIG. 5, the outline of the platform 621 is in the shape of a kidney, i.e. it is of generally curved shape with substantially constant width over the major fraction of the longitudinal extent of the platform 621.

This platform 621 constitutes an outer portion 621*a* forming the end of the top 62 of the vane 6, and presents an outer face that is substantially plane, and that in fact it preferably has the same radius of curvature as the outside face of the outer shroud 5.

Such a platform 621 is fabricated by conventional techniques of forging a blank for the entire vane 6 and of subsequent rectification by machining.

The outer shroud 5 presents openings 51 in transverse alignment, each opening 51 passing right through the wall of the outer shroud so as to receive the top 62 of a stationary vane 6, as described above. The openings 51 are generally elongate in a direction close to the direction of the axis X-X'.

Figure 2:
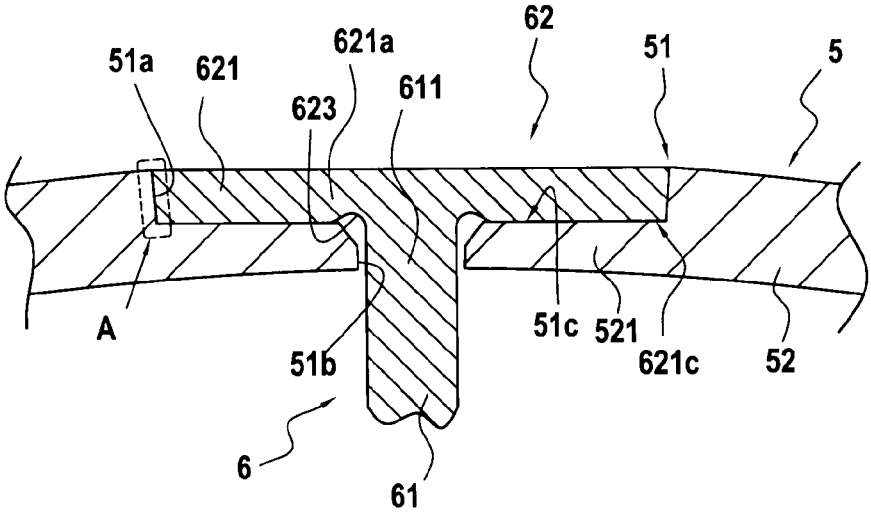
FIG. 2 is a fragmentary cross-section view showing the mounting between the top of a stationary vane and the opening in the outer shroud of a stator stage assembly in a first embodiment.

For this purpose, each opening 51 has an outer segment 51*a* that is open in the outside face of the outer shroud 5, and an inner segment 51*b* that is open in the inside face of the outer shroud 5 (downwards in FIGS. 2, 4, and 5).

The outer segment 51*a* and the inner segment 51*b* are joined together via a bearing face 51*c* that faces towards the outer segment 51*a* of the opening 51.

This configuration is a result of the fact that in radial projection, the outline of the outer segment 51*a* surrounds the outline of the inner segment 51*b* and defines the bearing face 51*c* that faces towards the outer segment.

Thus, the outer segment 51*a* of the opening 51 forms a setback that houses the platform 621 constituted by the outer portion 621*a*.

The inner segment 51*b* of the opening 51 defines a passage that houses the corresponding engaged portion of the vane as formed, in this first embodiment, by the connection zone 623 and the outer segment 611 of the body 61 of the vane 6.

It should be observed that this arrangement between the outer and inner segments 51*a*, 51*b* is easily obtained while machining the shroud, since the machine tools are free to move outside the outer shroud 5, i.e. a location that does not present any space restriction, unlike the concave inner side of the outer shroud 5.

As can be seen in FIGS. 4 and 5, in order to adapt to the various possible shapes that may be presented by the outline of the platform 621 received in the outer segment 51*a* of the opening 51, the outline of the outer segment 51*a* presents the shape of a regular polygon, in particular a quadrilateral, specifically a rectangle (FIG. 4), or else the shape of a kidney (FIG. 5).

It can be understood that in order to implement the welding operation properly between the outline of the outer segment 51*a* of the opening 51 and the outline of the platform 621, these outlines should be of identical shape with dimensions that are relatively close together, so that the outline of the outer segment 51*a* of the opening 51 is slightly larger than the outline of the platform 621 in order to be able to house it.

Figure 6:
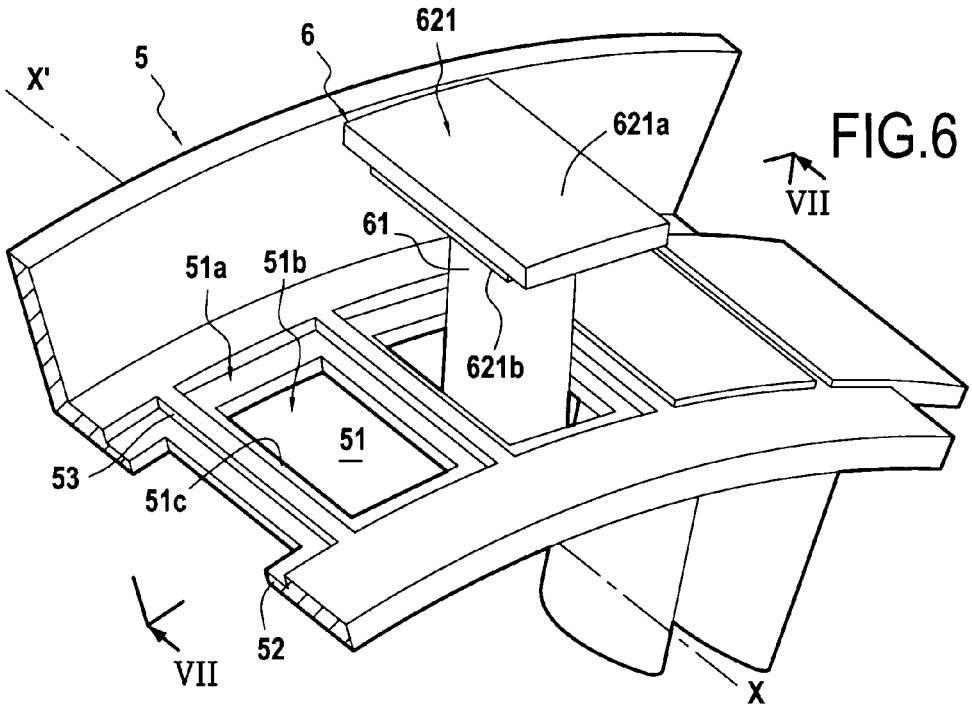
FIG. 6 is a fragmentary perspective view of a stator stage assembly in a second embodiment.

As can be seen in FIG. 6, the outer wall zone 53 of the shroud 5 extends between the outer segments 51*a* of the openings 51.

In FIG. 2, reference A designates the zone where the welded joint is located after the welding operation.

In the first embodiment, the outline of the inner segment 51*b* presents a shape analogous to the shape of the outline of the section in a radial plane of the body 61 of the vane, i.e. a kidney shape.

Likewise, in the first embodiment as shown in FIGS. 2 to 5, the thickness in the radius direction of the platform 621 corresponds substantially to the depth of the setback formed by the outer segment 51*a* of the opening 51.

Nevertheless, it is possible to provide for the thickness of the platform 621 to be smaller or greater than the depth of the outer segment 51*a* of the opening 51, providing a major fraction of the thickness of the platform 621 is housed in the outer segment 51*a* of the opening 51, with this being in order to make it possible to make a welded connection that presents sufficient strength.

Reference is now made to FIGS. 6 to 9 relating to a second embodiment of the invention, with only the differences relative to the first embodiment being described below.

In this embodiment, the platform 621 of each vane 6 is of a shape having two stages.

The platform 621 has an outer portion 621*a* forming the end of the top 62 of the vane 6, and an inner portion 621*b* connecting the outer portion 621*a* to the remainder of the vane 6, the outline of the outer portion 621*a* surrounding, in radial projection, the outline of the inner portion 621*b*.

Consequently, the outer portion 621*a* of the platform 621 is housed in the outer segment 51*a* of an opening 51 in the shroud, and the inner portion 621*b* of the platform 621 is housed in the inner segment 51*b* of the same opening 51, such that the inside face 621*c* of the outer portion 621*a* of the platform 621 bears against the bearing face 51*c* of the opening 51 in the shroud 5.

In this embodiment, the connection zone 623 connects the body of the vane 6 to the inner portion 621*b* of the platform 621.

The inner segment 51*b* of the opening 51 defines a passage that receives the corresponding engagement portion of the vane as constituted in this second embodiment by the inner portion 621*b* of the platform 621.

The welded connection is still made between the outline of the outer segment 51*a* of the opening 51 and the outline of the outer portion 621*a* of the platform 621. Under such circumstances, the inner portion 621*b* of the platform 621 is merely housed without any particular connection in the inner segment 51*b* of the opening 51, with the inside face 621*c* of the outer portion 621*a* bearing against the bearing face 51*c* of the inside wall zone 52 of the shroud.

As in the first embodiment, it will be understood that this arrangement makes it possible to avoid thermally affecting the top of the vane 6 and the top of its airfoil.

In addition, in the second embodiment, it is necessary to adapt the outline of the inner segment 51*b* of the opening 51 to the shape of the outline of the inner portion 621*b* of the platform 621. For this purpose, the outline of the inner segment 51*b* presents the shape of a regular polygon, in particular a quadrilateral, specifically a rectangle (see FIG. 6), or else a kidney shape (possibility not shown).

Figure 7:
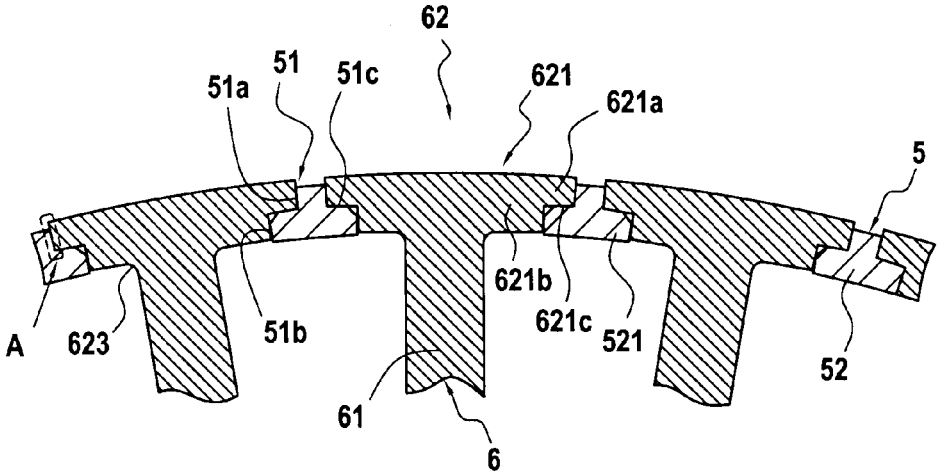
FIG. 7 is a fragmentary cross-section view showing the FIG. 6 stator stage assembly, after mounting, as seen looking along direction VII in FIG. 6.

In the second embodiment as shown in FIGS. 6 and 7, the outer segment 51*a* and the inner segment 51*b* of each opening 51, and the outer portions 621*a* and the inner portions 621*b* of each platform 621 are rectangular in shape, however this second embodiment having a staged platform is equally applicable for use with other shapes, in particular some other shape of regular polygon, in particular a quadrilateral, or else a kidney shape.

Also in the second embodiment, as shown in FIGS. 6 and 7, the thickness in a radial thickness of the outer portion 621*a* of the platform 621 is a little greater than the depth of the setback formed by the outer segment 51*a* of the opening 51.

Nevertheless, provision may be made for the thickness of the outer portion 621*a* of the platform 621 to have a thickness that is substantially equal to or slightly less than the depth of the outer segment 51*a* of the opening 51, providing a major fraction of the thickness of the outer portion 621*a* of the platform 621 is housed in the outer segment 51*a* of the opening 51, with this being for the purpose of enabling a welded connection to be made that is sufficiently strong.

In order to avoid any discontinuity or disturbance in the air flow section, the inner portion 621*b* of the platform 621 presents thickness in the radial direction that is substantially equal to the thickness of the inner segment 51*b* of the opening 51. In this way, and as can be seen in FIG. 7, the inside face of the shroud 5 and the inside face of the inner portion 621*b* of the platform 621 extend one another in a circumferential direction.

Figure 8:
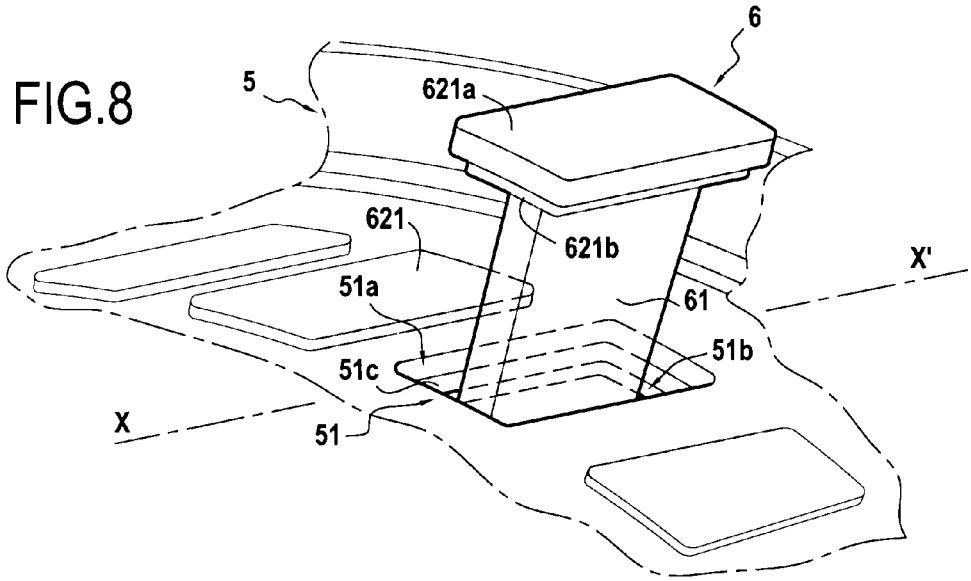
FIG. 8 is a view analogous to that of FIG. 6 for a variant embodiment.

Reference is made to FIG. 8 that shows a variant of the FIG. 6 embodiment in which the outlines of the outer segments 51*a* and the inner segments 51*b* of each opening 51, and the outlines of the outer portions 621*a* and the inner portions 621*b* of each platform 621 present rounded corners.

In FIG. 8, the outer segments 51*a* and the inner segments 51*b* of each opening 51 and the outer portions 621*a* and the inner portion 621*b* of each platform 621 are rectangular in shape, however this variant applies equally when other shapes are used, in particular some other regular polygon shape, in particular a quadrilateral, or else a kidney shape.

This variant also applies to the first embodiment in which the platform has only a single stage being constituted solely by the outer portion 621*a*.

It should be observed in FIG. 8 that the thickness of the outer portion 621*a* of the platform 621 is a little greater than the depth of the outer segment 51*a* of the opening 51.

Figure 9:
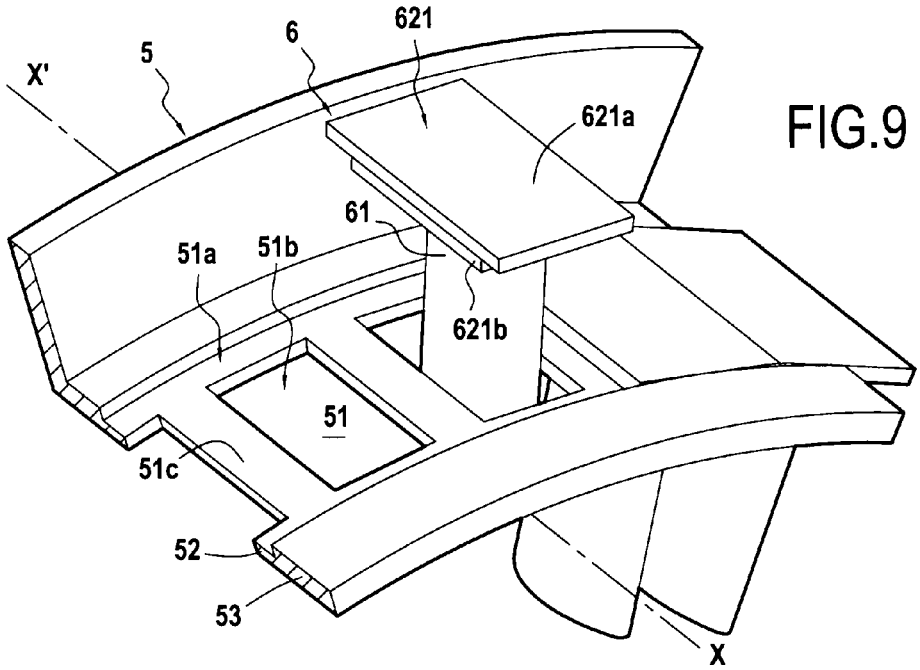
FIG. 9 is a view analogous to that of FIG. 6 for another variant embodiment.

With reference to FIG. 9, there can be seen another variant of the FIG. 6 embodiment.

In this variant, the outer segments 51*a* of the openings 51 together define an annular housing in the outside face.

In this variant, the bearing faces 51*c* of two adjacent openings 51 extend one another, and there is no longer any outside wall zone 53 between the two openings 51.

In this variant shown in FIG. 9, while welding the shroud 5 to each of the vanes 6, a fraction of the outline of the outer portion 621*a* of the vane in question (the two short sides of the rectangle in FIG. 9) is welded along the corresponding fraction of the edge of the outer segment 51*a* of the opening, and another fraction of the outer portion 621*a* of the vane in question (one of the two long sides of the rectangle in FIG. 9) is welded along a fraction of the outline of the outer portion 621*a* of the adjacent vane that has already been mounted in the adjacent opening.

This variant enables a maximum number of stationary vanes 6 to be installed in each stator stage, while ensuring great strength for the connection between the shroud 5 and each fixed vane 6. In this variant, the line of welding extends along the edges of the outer portions 621*a* of the platforms 621 of two adjacent vanes 6.

This variant is shown in FIG. 9, where it corresponds to the second embodiment, however it is equally applicable to the first embodiment: in such a configuration (not shown), the inner segments 51*b* of the openings 51 are narrower since they no longer house the inner portions 621*b* of the platforms 621, but only the connection zones 623 and the outer segments 611 of the outer bodies 61 of the vanes 6 (see FIG. 2).

It is also possible to envisage modifying the second embodiment (platform 621 with two stages) so that the outer segment 51*a* of the opening 51 (first hole) and the outer portion 621*a* of the platform 621 presents the shape of a rectangle (as in FIG. 6, where the outer portions 621*a* of the platforms 621 of two adjacent vanes 6 do not touch, or as shown in FIG. 9, where the outer portions 621*a* of the platforms 621 of two adjacent vanes 6 do touch), while the inner segment 51*b* of the opening 51 (second hole) and the inner portion 621*b* of the platform 621 present some other shape, and in particular a kidney shape.

In all embodiments, the outer portion 621*a* of the platform 621 (constituting the platform assembly in the first embodiment) presents thickness that is smaller than the thickness of the opening 51 in the outer shroud 5: it is the engagement portion situated immediately below the outer portion 621*a* of the platform 621 (connection zone 623 and outer segment 611 of the body 61 of the vane 6 in the first embodiment, and inner portion 621*b* of the platform 621 in the second embodiment) that is occupied by the inner segment 51*b* of the platform 621. This is possible since the outline of the outer segment 51*a* of the platform 621 surrounds the outline of the inner segment 51*b* of the platform 621. As a result, the inside face of the outer portion 621*a* of the platform 621 bears against the bearing face 51*c*.

The present invention also relates to a method of mounting the top 62 of at least one stationary vane 6 to an outer shroud 5 by welding, wherein the method comprises the following steps:

providing a vane 6 having a root and a top 62 with the body 61 of the vane 6 extending therebetween, which body is connected to the top 62 by an engagement portion, the top 62 including a non-pierced platform 621 constituting the terminal end portion;

providing an outer shroud 5 presenting a series of openings 51 in transverse alignment suitable for receiving respective platforms 621 and of outline that is substantially the same as the outline of the platform 621 of each vane 6, each opening 51 having an inner segment 51*b* opening into the inside face of the shroud 5 and an outer segment 51*a* forming a setback that opens into the outside face of the shroud 5, the outline of the outer segment surrounding, in radial projection and with a certain amount of spacing, the outline of the inner segment 51*b*, thereby defining a bearing face 51*c* facing towards the outer segment 51*a*, the shroud 5 not having any other hole for mounting the vanes;

housing the platform 621 of each vane 6 in a respective opening 51 such that the inside face of the platform 621 comes to bear against the bearing face 51*c* of the shroud 5; and welding the vane 6 to the shroud 5 from the outside face of the shroud 5 along the edge of the outer segment 51*a* of the opening 51 so as to secure the entire outline of the platform 621 to the shroud 5.

The welding may be performed by any available welding technique, in particular electron beam welding, laser welding (such as a high power $CO_2$ laser), or tungsten inert gas (TIG) type arc welding.

Mention may be made of various specific provisions that are applicable to all embodiments coming within the ambit of the present invention.

Thus, it should be observed that the shroud 5 does not have any holes other than the openings 51 for mounting the vanes 6, since according to the invention welded connections are used between the vanes 6 and the outer shroud 5, as opposed to connections that are bolted or riveted.

The weld bead is formed on the outside face of the shroud connecting the edge of the outer segment of the opening 51 to the outline of the platform 621.

As mentioned above, preferably at least a major fraction of the thickness of the platform 621 is housed in the outer segment 51*a* of the opening 51 in the shroud 5, and/or the thickness of the platform 621 is equal to or greater than the thickness of the outer segment 51*a* of the opening 51 in the shroud 5.

In addition, and advantageously, provision is made for the outline of the platform 621 to surround the outline of the body 61 of the vane 6 radial projection. In this way, since the radial projection of the outer portion 621*a* of the platform is spaced apart from the body 61 of the vane 6, the body 61 does not lie in the direction of the welding beam from the line of welding that is made.

By means of such a provision, since the welding path lies outside the radial projection of the vane 6, it is ensured that the airfoil is protected from any damage, in the event of the welding beam being maladjusted.

In addition, because in radial projection, the weld bead lies outside the outline of the vane 6, this provision makes it possible to perform non-destructive inspections of the weld bead using X-rays, since the images are not hampered by the presence of the vane 6.

Under such circumstances, the weld bead presents a certain length, thus enabling the forces to which it is subjected to be spread over an area that is larger, given that it constitutes a zone that is weakened by welding since welding deteriorates mechanical properties.

What is claimed is:

1. An outer shroud for a stator stage of a turbomachine, wherein the shroud presents an axis of circular symmetry, the outer shroud comprising:

a series of transversely-aligned openings suitable for receiving tops of stationary vanes, each of the vanes including a platform that is suitable for penetrating into a respective one of said openings so to enable each respective stationary vane to be mounted by welding between an edge of the respective opening and an outline of its platform, wherein each opening includes an inner segment opening into an inside face of the shroud and an outer segment opening into an outside face of the shroud, an outline of the outer segment surrounding, in radial projection, an outline of the inner segment, thereby defining a bearing face which connects the inner segment to the outer segment and which faces towards the outer segment, wherein a thickness of each respective opening is greater than a thickness of an outer portion of each respective platform, and an inner face of the outer portion of each respective platform abuts the bearing face of each respective opening, wherein the shroud does not include any other holes for mounting the vanes, and wherein the outline of the outer segment presents the shape of a quadrilateral.

2. The outer shroud according to claim 1, wherein the outline of the inner segment presents a shape of a regular polygon or a kidney shape.

3. The outer shroud according to claim 1, wherein the outer segments of the openings define, in the outside face, an annular housing.

4. The outer shroud according to claim 1, wherein the outer segment presents rounded corners.

5. An assembly for a stator stage of a turbomachine, the assembly comprising:

an outer shroud presenting a transversely-aligned series of openings for mounting stationary vanes, each opening including an inner segment opening into an inside face of the shroud and an outer segment opening into an outside face of the shroud, an outline of the outer segment surrounding, in radial projection, an outline of the inner segment, thereby defining a bearing face connecting the inner segment to the outer segment and facing towards the outer segment, the shroud not including any other holes for mounting the vanes, and the outline of the outer segment presenting the shape of a quadrilateral; and least one stationary vane comprising a root and a top with a body of the vane extending therebetween, the body is connected to the top by an engagement portion, the top including a non-pierced platform that is received in a respective one of said openings so that an inside face of the platform abuts the bearing face of the shroud, and an outline of the platform presenting a shape that is identical to the outline of the opening, wherein a thickness of an outer portion of the platform is less than a thickness of the opening in the outer shroud, and wherein the platform of the vane is welded to the outer shroud via a welded connection between the outline of the outer segment of the opening and the outline of the outer portion of the platform.

6. The assembly according to claim 5, wherein at least a major fraction of the thickness of the platform is housed in the outer segment of the opening in the shroud.

7. The assembly according to claim 5, wherein the thickness of the platform is equal to or greater than the thickness of the outer segment of an opening in the shroud.

8. The assembly according to claim 5, wherein the outer portion of the platform forms an end of the top, and an inner portion of the platform forms part of the engagement portion and connects the outer portion to a remainder of the vane, the outline of the outer portion surrounding an outline of the inner portion, the outer portion of the platform being housed in the outer segment of the opening in the shroud and the inner portion of the platform being housed in the inner segment of the same opening so that the inside face of the outer portion of the platform abuts the bearing face of the shroud.

9. The assembly according to claim 5, wherein, in radial projection, the outline of the platform surrounds an outline of the engagement portion of the vane.

10. The assembly according to claim 5, wherein an outline of the inner segment presents a shape of a regular polygon or a kidney shape.

11. A stator stage for an axial compressor or a turbine including at least one assembly according to claim 5.

12. An axial compressor including a stator stage according to claim 11.

13. A turbine including a stator stage according to claim 11.

14. A turbomachine including a turbine according to claim 13.

15. A turbomachine including an axial compressor according to claim 12.

* * * * *